US005259778A

United States Patent [19]

Zhang

[11] Patent Number: 5,259,778

[45] Date of Patent: Nov. 9, 1993

[54] METHOD FOR SAFETY NON-ARCING ELECTRIC CONNECTION AND THE DEVICE USING THE SAME

[76] Inventor: Ning Zhang, 11-5-10, Shui Nian He Bei Er Street, Cheng Du City, Sichuang Province, P.R., China

[21] Appl. No.: 911,626

[22] Filed: Jul. 10, 1992

[30] Foreign Application Priority Data

Feb. 24, 1992 [CN] China ..... 92214179.7
Mar. 10, 1992 [CN] China ..... 92108054.9

[51] Int. Cl.[5] ..... H01R 13/71

[52] U.S. Cl. ..... 439/188; 200/51.09; 439/332

[58] Field of Search ..... 439/188, 332, 337; 200/51.07, 51.08, 51.09, 50 B

[56] References Cited

U.S. PATENT DOCUMENTS

| | | | |
|---|---|---|---|
| 1,753,179 | 4/1930 | Wertz | 439/335 |
| 1,774,230 | 8/1930 | Fagerlund | 200/50 B |
| 2,127,473 | 8/1938 | Sacco | 200/51.08 |
| 2,787,676 | 4/1957 | Kellogg et al. | 200/51.09 |
| 2,857,570 | 10/1958 | Simpson | 439/678 |

FOREIGN PATENT DOCUMENTS

| | | | |
|---|---|---|---|
| 1167763 | 11/1958 | France | 200/51.09 |
| 1333873 | 6/1963 | France | 200/51.09 |
| 627714 | 8/1949 | United Kingdom | 200/51.09 |

*Primary Examiner*—Neil Abrams
*Attorney, Agent, or Firm*—Roylance, Abrams, Berdo & Goodman

[57] ABSTRACT

A method for safety non-arcing electric connection and the device using the same, which are adapted to complete the electric connection of common domestic appliances with power supply. The device comprises a socket unit which consists of a socket cover, a socket case, an insertion element and a connection element, and a plug which has a position means. The method is performed by means of insertion and turning. Three positions are defined by several pairs of pillar shaped teeth which cooperate with a pair of pillar shaped projections on the inside of the socket case. Also, electrical contact is established and broken by rotation of the insertion element relative to the socket unit. The device has advantages of safety, simple structure, convenient operation and no arcing.

6 Claims, 21 Drawing Sheets

METHOD FOR SAFETY NON-ARCING ELECTRIC CONNECTION AND THE DEVICE USING THE SAME

INTRODUCTION

The present invention relates to a method for safety non-arcing electric connection and device using the same, and particularly to a method for electric connection with common mains supply and the device thereof. The method and device thereof can be adapted to complete the electric connection of common domestic appliances with power supply, for example, the connection of the plug affixed in an appliance with a socket, the connection of a plug with a patch board or cassette socket, and the connection of a plug with a specific removable socket (for example, the removable socket used in an electric cooker).

The connecting and detaching steps of the method and device provided by the present invention are as follow: Inserting the plug into the socket without connecting with the power supply at an original position →Turning the turnable one of them with respect to the other to a final position →Completing the electric connection of the pins of the plug with the power supply at the final position; When desired to disconnect, Turning the turnable one reversely away from the final position →Disconnecting the pins of the plug with power supply →Pulling out the plug to detach the plug from the socket at the original position. From the above steps it can be found that the device made according to the present method has such a structure that no arcing is produced during the connection and disconnection by means of the pins contacting the contact points of power supply wire at the same time. Furthermore, the danger caused by an accidental insertion into the socket can be avoided by means of the electric connection being completed not by insertion only but also by turning.

BACKGROUND OF THE INVENTION

Generally, it is the common method for electric connection and disconnection adapted in domestic appliances that the plug is directly inserted into the jacks of the socket to connect the power supply and that the plug is pulled out to disconnect. However, this method and device thereof have disadvantages of arcing produced because it is difficult for manual operation to have the pins of the plug connecting the power supply at the same time. Additionally, It is possible for persons (especially children) using the prior device to get an electric shock resulted from an accidental insertion because of the direct connection of the plug with the power supply.

Accordingly, an object of the invention is to provide a convenient, simple and safe method for electric connection and the device using the same with the new structure to avoid arcing.

SUMMARY OF THE INVENTION

To this end, according to a first aspect of the invention, the present invention provides a method for safety non-arcing electric connection, which comprises following steps:

inserting pins of a plug into jacks of a socket without electric connection;

turning either said plug or said socket with respect to the other away from the original position;

turning above turned one to a final position where said pins of said plug connect with contact points of electric power so as to apply electric power;

performing above turning reversely, namely, turning above turned one reversely away from the final position to detach said pins from said contact points of the electric power to disconnect the electric power;

turning above turned one to the original position; and pulling out said plug.

According to a second aspect of the invention, the present invention provides a safety non-arcing electric connection device, which comprises a plug and a socket unit, said plug comprises pins connected with wires, a plug body and position means for guiding the insertion of said plug;

said socket unit comprises a socket cover, a socket case, an insertion element and a connection element; one end of said socket case is fixedly closed by said socket cover and the other end thereof has a wire hole through which an electric power wire passes; said insertion element and said connection element are arranged in a space formed by said socket cover and said socket case;

a plurality of arcuate grooves are formed through said socket cover; the number, width, and position with respect to the center of said socket unit and relative to each other of said grooves are corresponding to the number, size of the cross sections, and position with respect to the center of said plug and relative to each other of said pins, so that said pins can be inserted into said grooves and so that said plug and said socket are enabled to rotate relative to each other;

said insertion element is a round block which has jacks; the number, shape, size, and position with respect to the center of insertion element and relative to each other of said jacks are corresponding to the number, shape of the ends, size, and position with respect to the center of the plug and relative to each other of said pins, so that said pins are able to be inserted into said jacks; each of said jacks has a conductive element; around the outer circumferential surface of said insertion element there are teeth generally uniformly formed with curved shapes of the cross sections; and said insertion element also has axially positioning means;

said connection element with contact points for connecting electric power is fixedly arranged in the socket case; the number, and position with respect to the center of said socket case and relative to each other of said contact points are corresponding to the number, and position with respect to center of said plug and relative to each other of said pins, so that said pins are able to contact with and detach from said contact points at the same time;

a cylindrical space with a diameter slightly greater than the diameter of maximum enveloping curve of said insertion element is formed between said socket cover and said connection element; a plurality of projections are generally uniformly formed and extends centripetally on the inner surface of said cylindrical space; said insertion element is turnably arranged in said cylindrical space with restriction of axial movement.

Preferably, said position means for guiding the insertion of said plug comprises protrusions which are formed in the plug body and extend centripetally, and concaved areas which are formed at the outer side of said socket unit to receive said protrusions.

Additionally or alternatively, said position means for guiding the insertion of said plug comprises protrusions which are formed on the plug body and extend radially outwardly, and concave areas which are formed in said socket cover and near the outer side thereof to receive said protrusions.

Additionally or alternatively, said position means for guiding the insertion of said plug has such a structure that: at least one enlarged portion is formed at the end of each of said pins; the width of said arcuate grooves is greater than the maximum size of the cross sections of the pins and less than the maximum size of the cross sections of the enlarged portions of the pins; at each of two corresponding ends of said grooves there is an enlarged portion of said grooves, the diameter of which is greater than the maximum size of the cross sections of the enlarged portions of said pins.

Preferably, said cylindrical space is formed by the inner surface of said socket case.

Additionally and alternatively, said cylindrical space is formed by the inner surface of a cylinder which is formed and axially extends on the socket cover.

Preferably, said axially positioning means of said insertion element comprises a stepped needle post which is formed at the center of the insertion element and extends along the center line thereof, and a stepped hole which is formed at the center of said socket cover to receive above stepped needle post.

Additionally or alternatively, said axially positioning means of said insertion element comprises a needle post and a needle post hole which receives said needle post; said needle post in alignment with the center of said insertion element is fixed with respect to said socket case, extends along the center line of said insertion element, and preferably terminates in tapered tip; said needle post hole is arranged at the center of said insertion element and preferably terminates in tapered bottom.

Preferably, said conductive elements can be metal sleeves.

Preferably, said connection element can be made of printed circuit board.

Further objects and advantages of the invention will appear from the following description taken together with the accompanying drawings

DETAILED DESCRIPTION OF THE EMBODIMENTS

The electric connection device according to the first embodiment of the invention is adapted in electric cookers. The device comprises a turnable socket unit, i.e. a manually movable socket unit, and a common plug which is formed integrally on the electric cooker and has two round pins.

FIGS. 1–4 are views showing an assembly and main parts of the present embodiment.

Figures 1, 2:
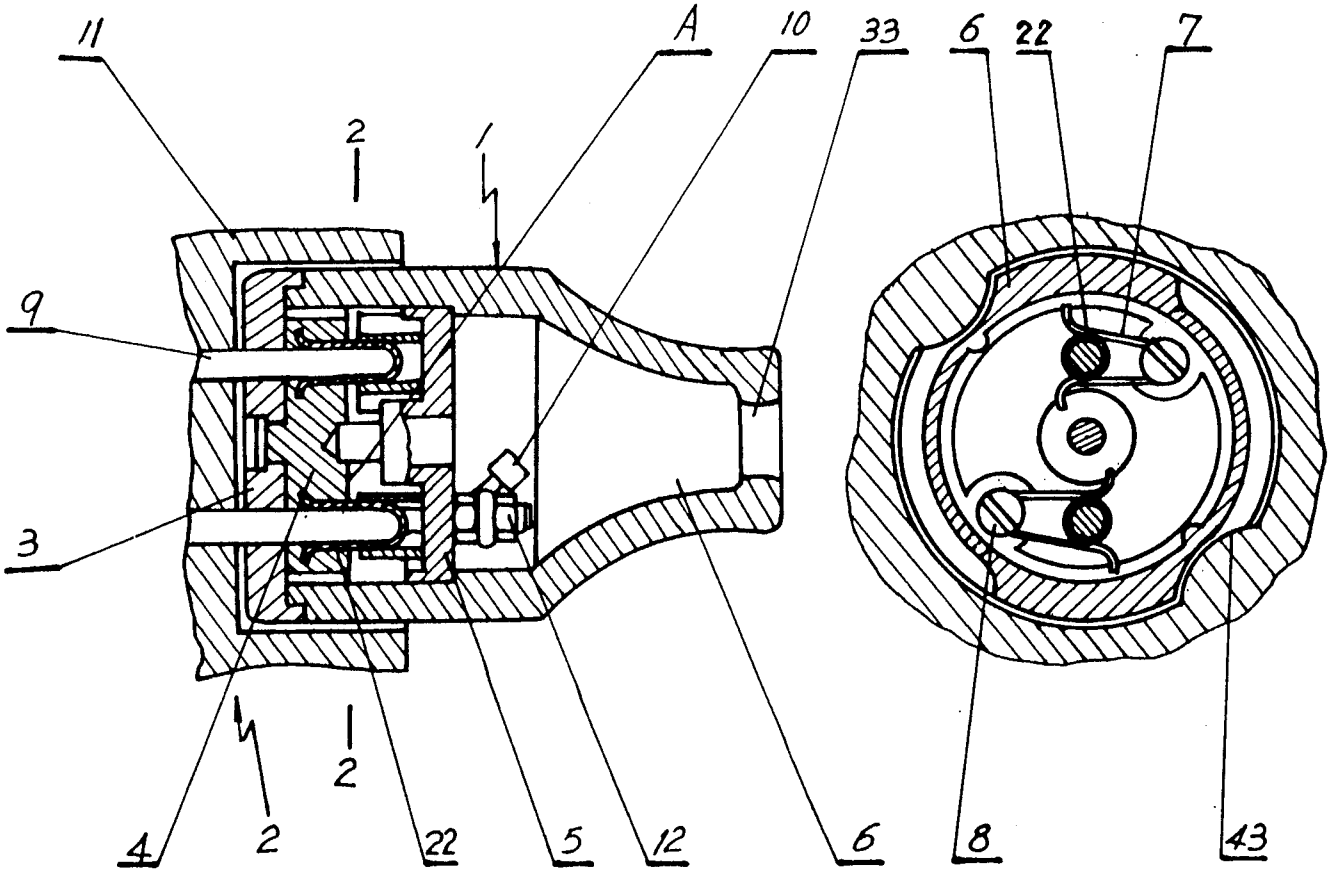
FIG. 1 is a schematic sectional front view showing an assembly according to the first embodiment of the invention.
FIG. 2 is a schematic sectional side view showing that the plug and the socket have been electrically connected together and that electric power is supplied.
Figure 3:
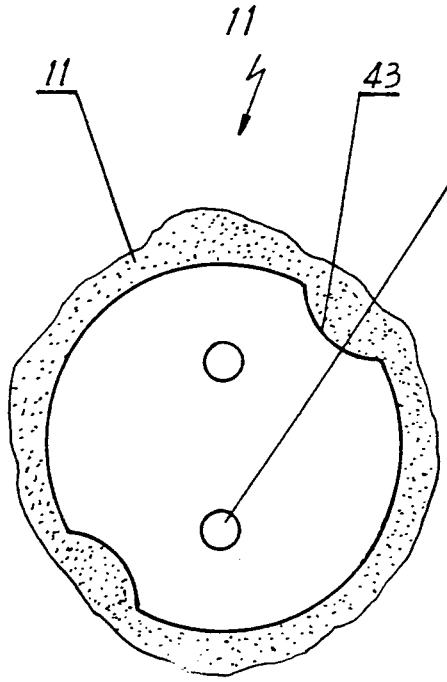
FIG. 3 is a schematic front view of the plug according to the first embodiment of the invention, showing that the pins of the plug are formed integrally on the body of a domestic appliance, for example, an electric cooker.
Figure 4:
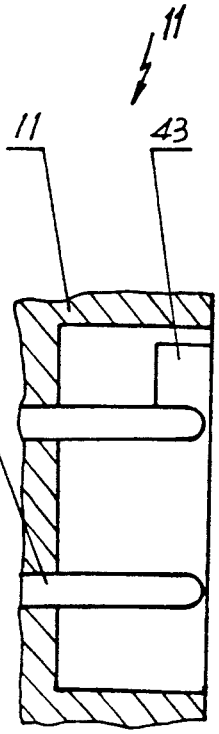
FIG. 4 is a schematic sectional side view of the plug in FIG. 3.
Figure 5:
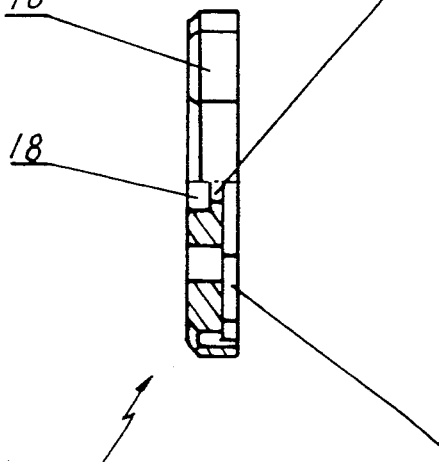
FIG. 5 is a schematic partially sectional front view of the socket cover of the turnable socket unit according to the first embodiment of the invention.
Figures 12, 13, 14:
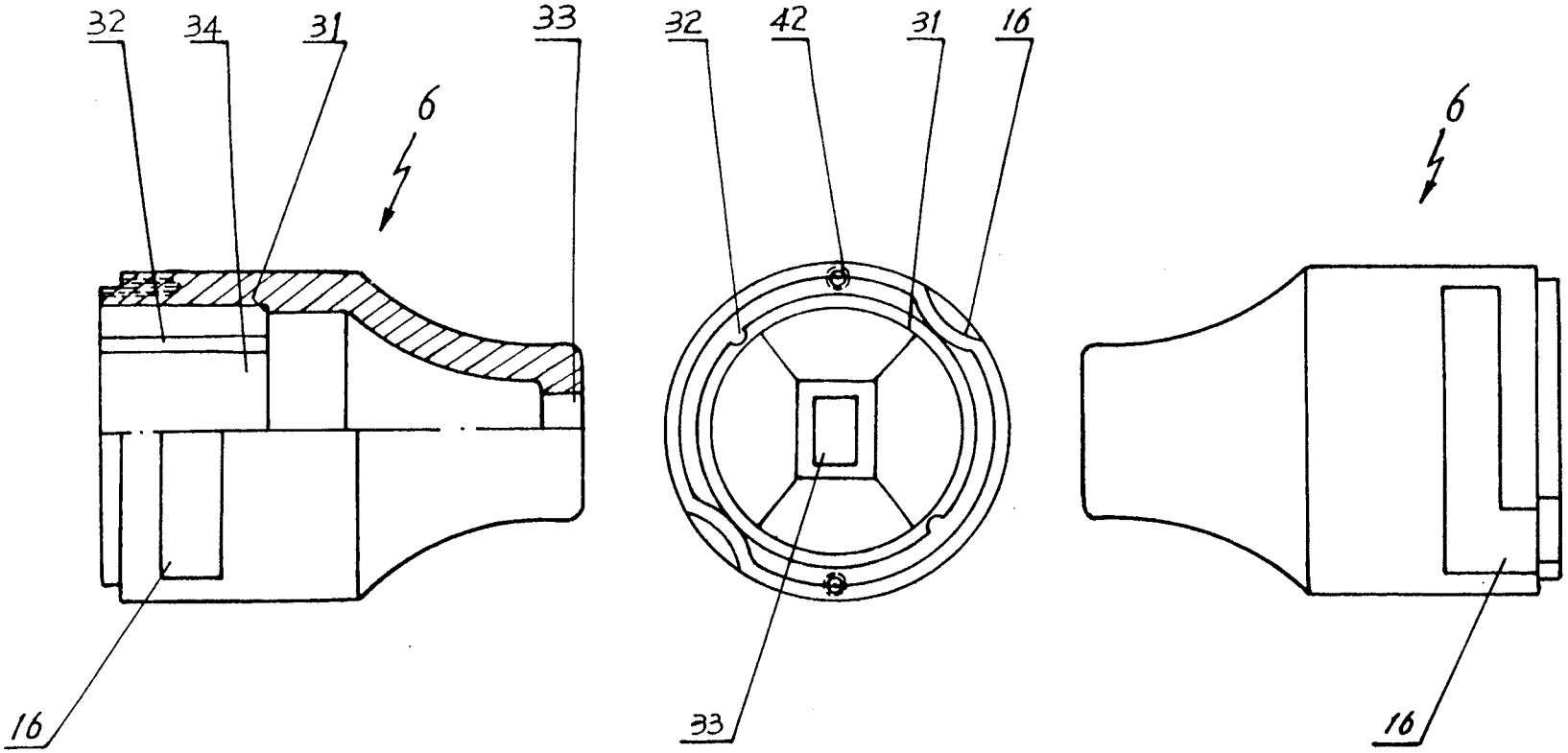
FIG. 12 is a schematic partially sectional front view of the socket case of the turnable socket unit according to the first embodiment of the invention.
FIG. 13 is a schematic side view of the socket case in FIG. 12.
FIG. 14 is a schematic front view of the socket case in FIG. 13.

Referring to FIGS. 1 and 2 which show that the plug 2 and the socket unit 1 have been electrically connected and that electric power is applied. The plug body 11 is one portion of the electric cooker body. As shown in these figures, pins 9 have coupled with the conductive elements 22 which are metal sleeves which can electrically connect with the conductive reeds 7 (contact points) to turn on electric power. Protrusions 43 are provided in the plug body 11 and extend centripetally. Concave areas 16 are formed in the socket case 6 and the socket cover 3, and extend axially and then circumferentially, as shown in FIGS. 4 and 14. The protrusions 43 cooperate with the concave areas 16 to guide the insertion of the plug 2 (see FIGS. 5,6,13,14). During connection, the protrusions 43 move axially and then circumferentially along the concave areas 16 which not only the guide the insertion of the plug 2 but also ensure the rotation of the socket unit 1 with respect to the plug 2.

The socket unit 1 consists of the socket cover 3, an insertion element 4, a connection element 5 and the socket case 6. The socket case 6 is generally hollowly cylindrical, one end of which is fixedly closed with the socket cover 3, and the other end of which is tapered and terminates in a wire hole 33.

Figure 6:
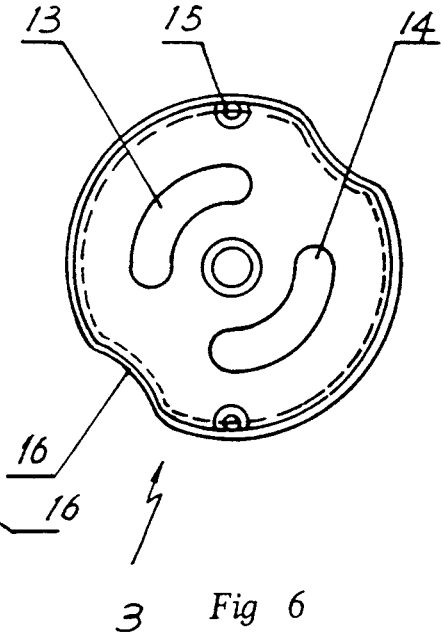
FIG. 6 is a schematic side view of the socket cover in FIG. 5.

In the socket cover 3 there are two through arcuate grooves 13. 14 formed (FIG. 6). A stepped hole 17,18 (referring to FIGS. 5, 6) is provided at the center of the socket cover 3. The width of the arcuate grooves 13 is greater than the diameter of the pins 9 and the radius of the arcuate grooves is equal to the distance between the center of the plug 2 and the center line of the pins 9.

Figures 10, 11:
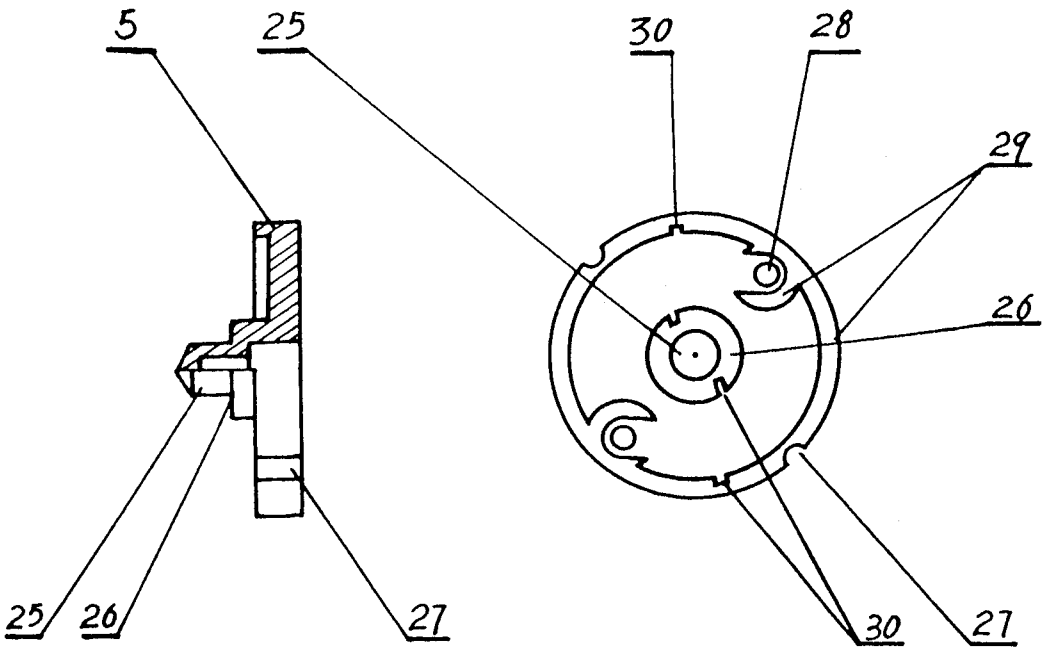
FIG. 10 is a schematic partially sectional front view of the connection element of the turnable socket unit according to the first embodiment of the invention.
FIG. 11 is a schematic side view of the connection element in FIG. 10.

A needle post 25 is formed at the center of the connection element 5 along the center line thereof, and terminates in a tapered tip, see FIGS. 10 and 11. The connection element 5 is affixed in the socket case 6 with terminals 12 thereon connected with electric wire 10. The reeds 7 are fixed on the connection element 5 by screws 8 (FIG. 2). Each of the reeds 7 with its end restricted in the groove 30 is positioned between the position platform 26 and the restricting platform 29. Two position recesses 27 are formed on the outer circumferential surface of the element 5 to receive the circular projections 32 of the socket case 6, FIG. 12.

Figures 7, 8, 9:
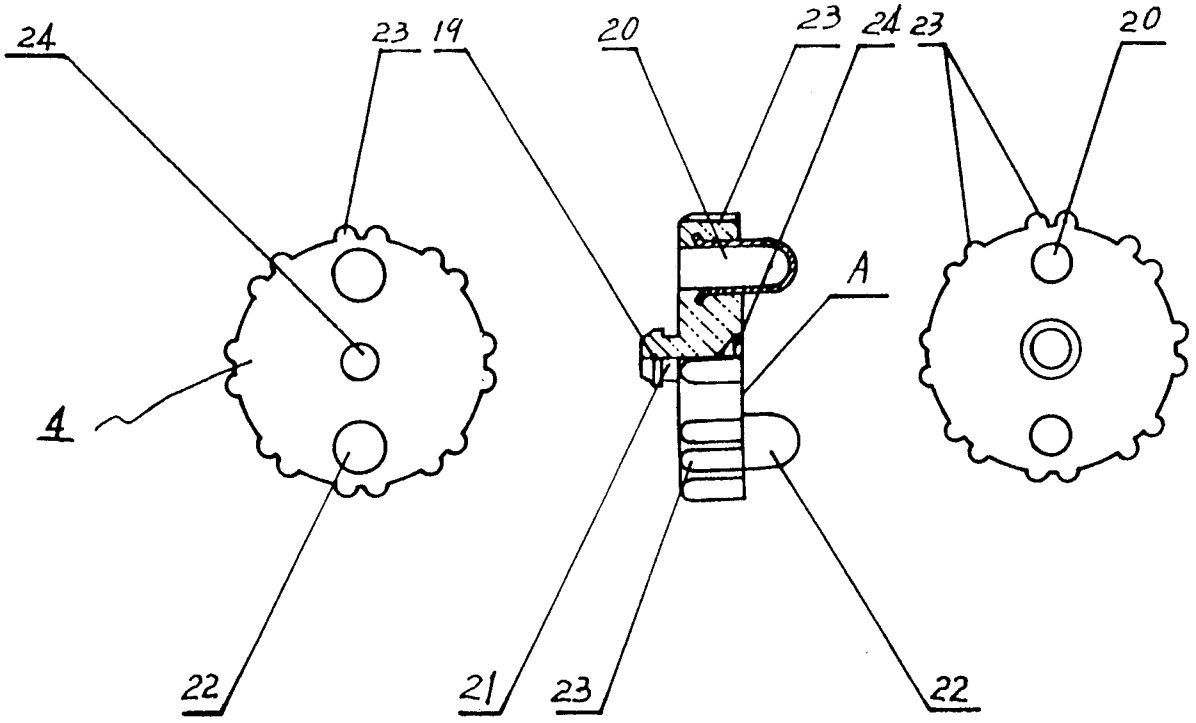
FIG. 7 is a schematic partially sectional front view of the insertion element of the turnable socket unit according to the first embodiment of the invention.
FIGS. 8 and 9 are two schematic side views of the insertion element in FIG. 7.

The insertion element 4 is a round block and has 8 pairs of teeth 23 formed around the outer circumferential surface thereof. A stepped projection 19, 21 (see FIGS. 7,8,9) is formed at the center of the insertion element 4 and extends along the center line thereof. Through the element 4 there are also two round jacks 20 to respectively receive one conductive element 22 which is the metal sleeve. On the center of the other side (A Side) of the insertion element 4 a needle post hole 24 is provided with a tapered bottom.

The cylindrical space 34 (see FIG. 12) is formed in the socket case 6 between the socket cover 3 and the connection element 5, on the inner surface of which two circular projections 32 (see FIGS. 12, 13) are provided centripetally at the inner surface of the socket case 6. The diameter of the cylindrical space 34 is sightly greater than that of the enveloping curve of the insertion element 4 to enable the element 4 to be turnable in the space when mounted therein. The projection 19, 21 can be inserted into the stepped hole 17, 18 of the socket cover 3 (see FIGS. 1, 5, 7) and the needle post hole 24 cooperates with the needle post 25 (see FIGS. 1, 7,10), resulting in the restriction of the axial movement of the insertion element 4 with the freedom of circumferential movement.

Figure 18:
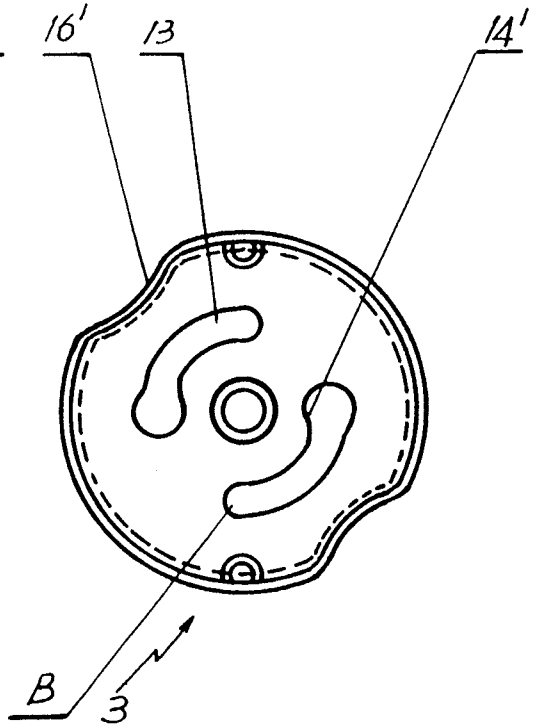
FIG. 18 is a schematic side view of the socket cover in FIG. 17.

The socket cover 3, the socket case 6, the insertion element 4, and the connection element 5 are arranged generally axially. After assembly, the socket cover 3 and the connection element 5 are fixed with respect to the socket case 6, and the insertion element 4 is turnable around its center line under the force of the pins 9, but without any ability of axial movement. During connection, first the protrusions 43 of the plug body 11 are aligned with the axially extending portions of the concave areas 16 in the cover 3 and the case 6, then the pins 9 are inserted from the ends 14 of the arcuate grooves 13 into the conductive elements 22 mounted in the jacks 20 of the insertion element 4. Then the socket unit 1 is rotated away from the original position. The socket unit 1 is enabled to be turnable by means of the circumferential portions of the areas 16 and the circular grooves 13, 14 along which the protrusions 43 and the pins 9 move respectively. Then the rotation of the pins 9 in the jacks 20 drives the insertion element 4 to rotate until the pins arrive at the B ends (FIG. 18) of the arcuate grooves 13, 14 which is the final position where the conductive elements 22 with the pins 9 are connected with the reeds 7 (contact points), to complete the electric connection. If desired to detach, turning the socket plug 1 reversely away the final position until the protrusions 43 are respectively in alignment with the axial portions of the concave areas 16 (the original position) to disconnect the conductive elements 22 from the reeds 7; and pulling out the socket unit 1 so that the electric cooker is able to be moved away.

Figure 16:
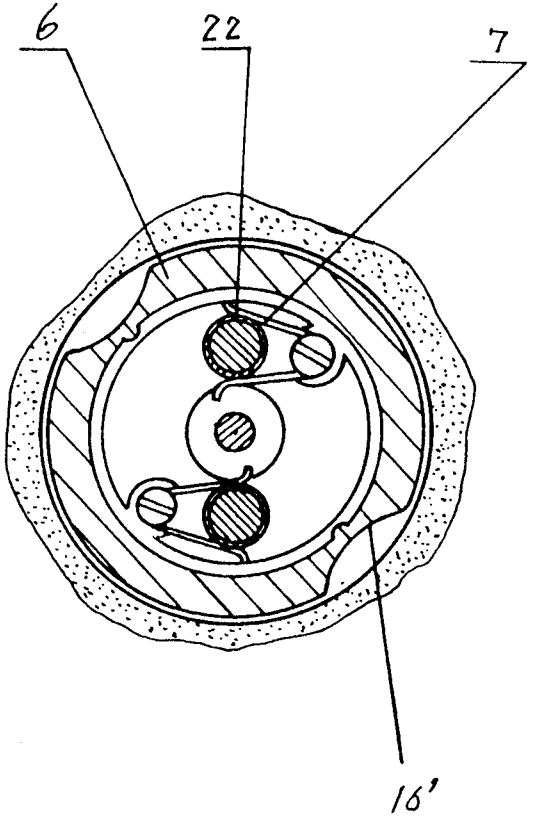
FIG. 16 is a schematic sectional side view of the assembly in FIG. 15.
Figure 15:
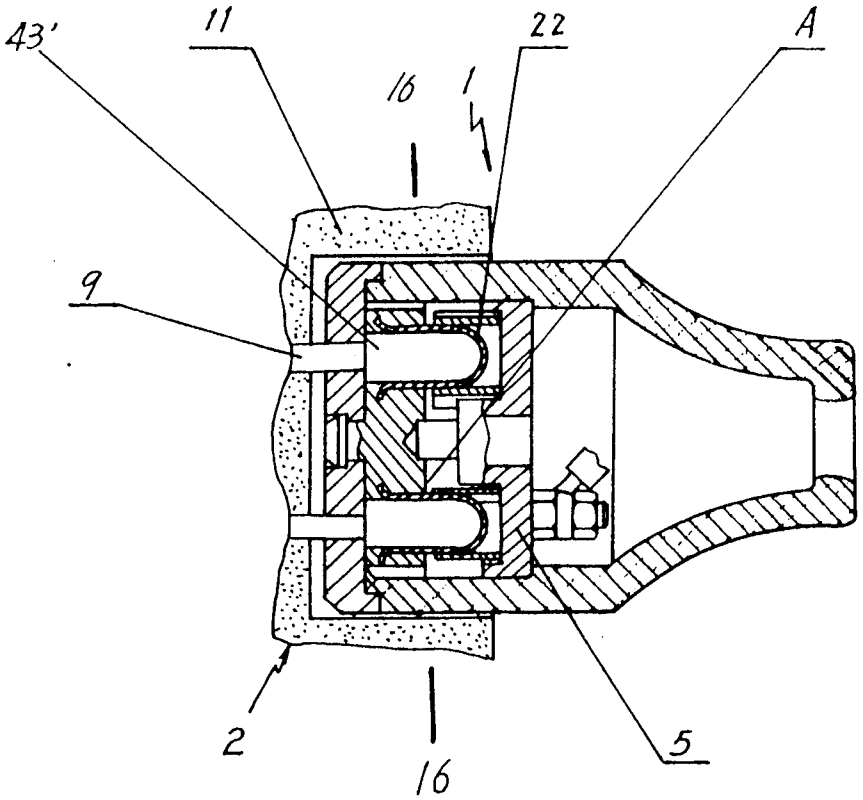
FIG. 15 is a schematic sectional front view of an assembly according to the second embodiment of the invention.

The electric connection device provided by the second embodiment of the present invention has a generally same structure as the one provided by the first embodiment. In this embodiment the protrusions 43 of the plug body and the concaved areas 16 of the socket unit 1 are not provided. Being a replacement, on the socket unit there are only recesses 16' for conveniently manual operation; and the pins 9 respectively terminate in enlarged ends 43' (see FIGS. 15, 16).

Figure 17:
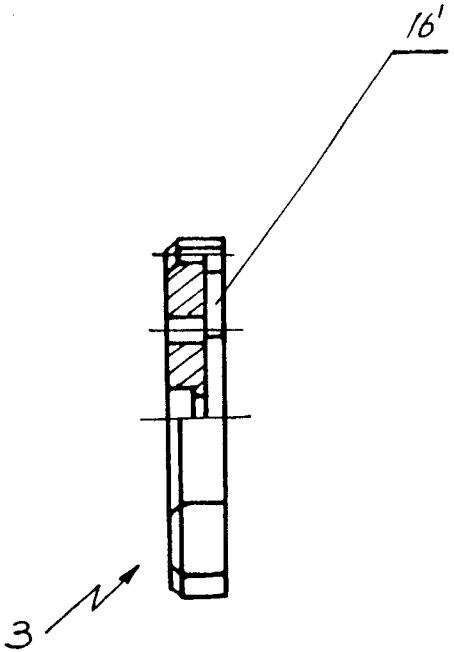
FIG. 17 is a schematic partially sectional front view of the socket cover in FIG. 15.
Figure 19:
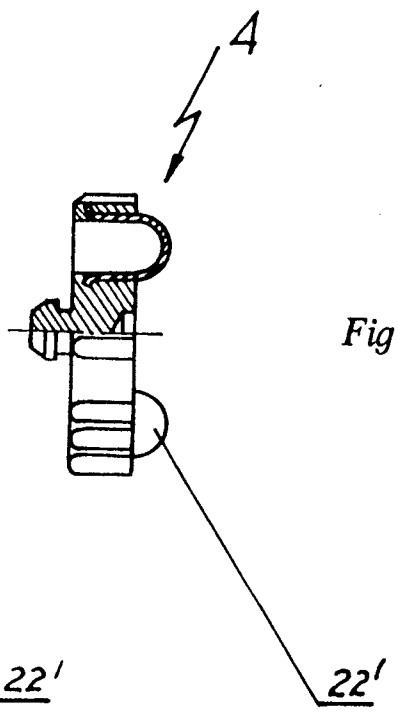
FIG. 19 is a schematic partially sectional front view of the insertion element of the second embodiment showing in FIG. 15.
Figure 20:
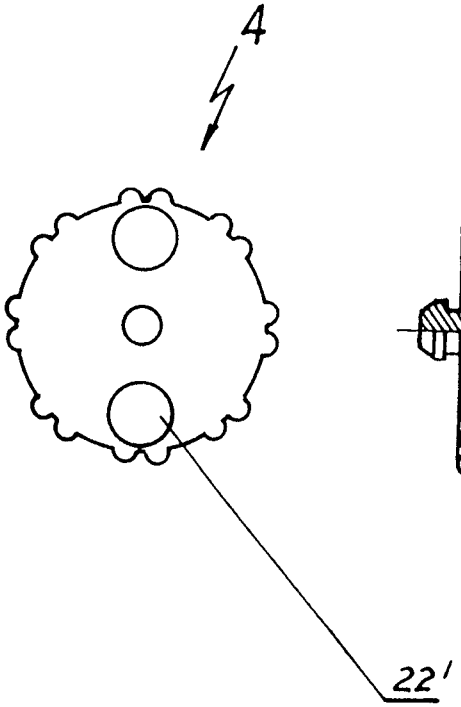
FIG. 20 is a schematic side view of the insertion element in FIG. 19.
Figure 22:
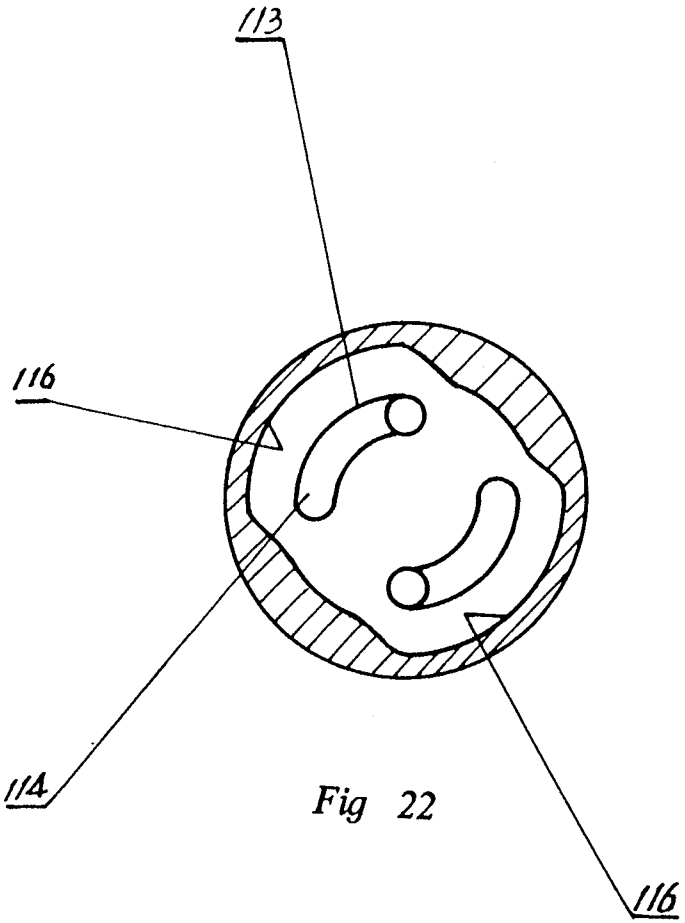
FIG. 22 is a schematic partially sectional view of the assembly in FIG. 21.

At the corresponding end of each arcuate grooves 13 of the socket cover 3 there is an enlarged portion 14' formed (FIG. 17), the width of which is greater than the diameter of the enlarged ends 4 3' of the pins 9. The width of the other portion of the grooves 13 is greater than diameter of the pins 9 and less than the diameter of the enlarged ends 43' (see FIGS. 17, 18).

Additionally, the shape and size of the enlarged ends 43' of the pins 9 are correspondent to that of the jacks in the insertion element 4, especially that of the conductive elements 22' mounted therein.

The electric connection steps of above device are as follow: inserting the pins 9 at the enlarged portions 14' of the grooves 13 into the conductive elements 22' and then turning the socket unit 1 until the pins reach the B ends (final position) of the grooves 13 in such a manner that the insertion element 4 is forced to rotate to a place where the conductive elements 22' connects with the reeds 7 fixed on the connection element 5 to turn on the electric power. Turning reversely, the plug can be pulled out to detach the electric connection.

The FIGS. 21-35 are respectively views of an assembly and the main parts according to the third embodiment of the invention. In this embodiment the device comprises a built-in socket unit 101 and a common plug 102. The socket unit 101 consists of a socket case 106, a socket cover 103, an insertion element 104 and a connection element 105.

Figure 21:
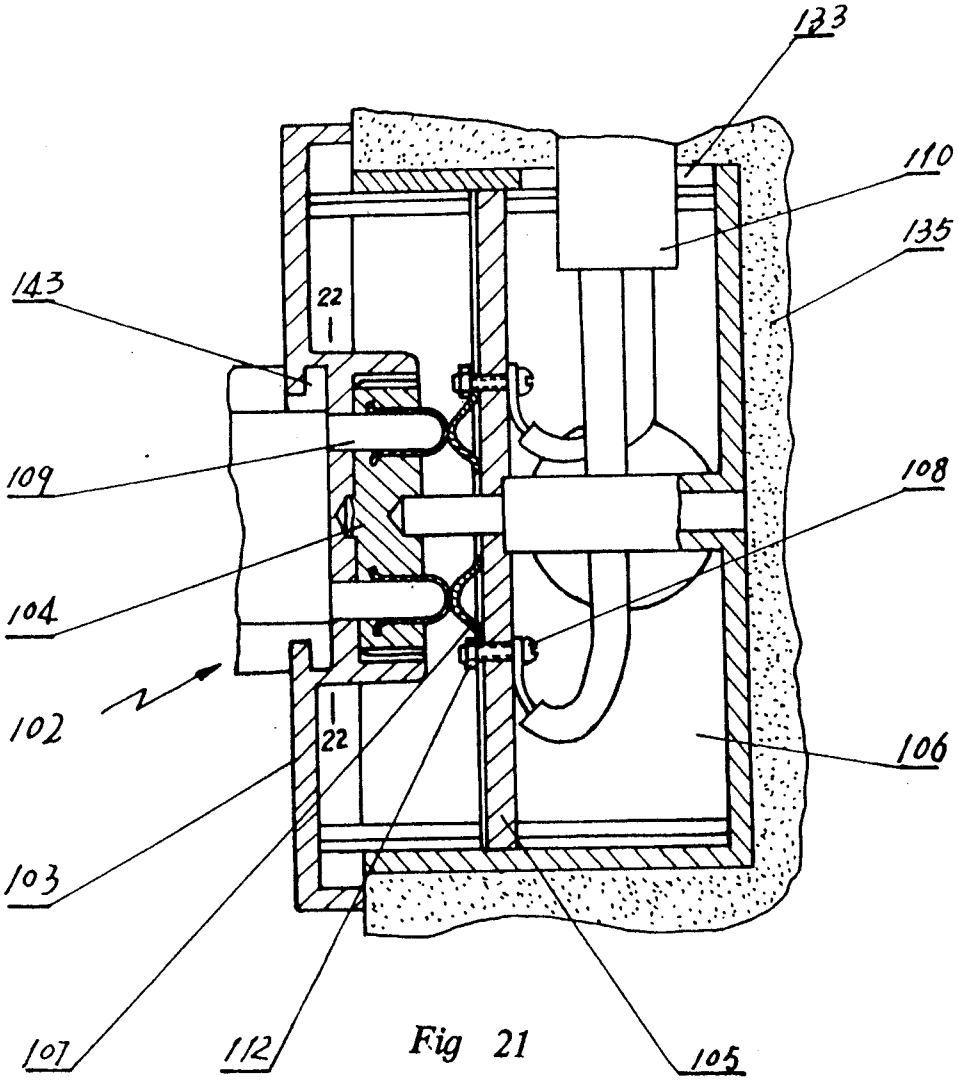
FIG. 21 is a schematic sectional front view of an assembly according to the third embodiment of the invention.
Figure 23:
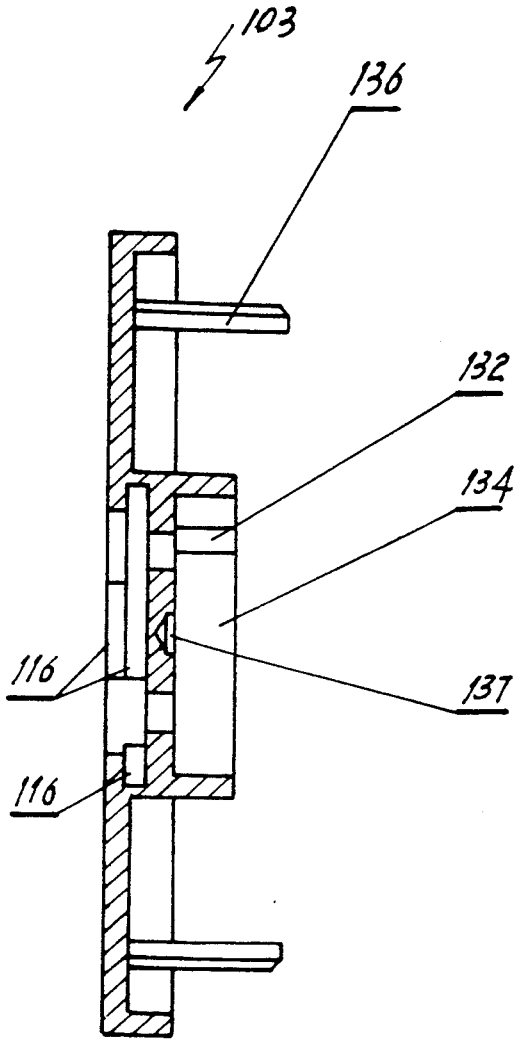
FIG. 23 is a schematic sectional front view of the socket cover of the third embodiment of FIG. 21.
Figure 24:
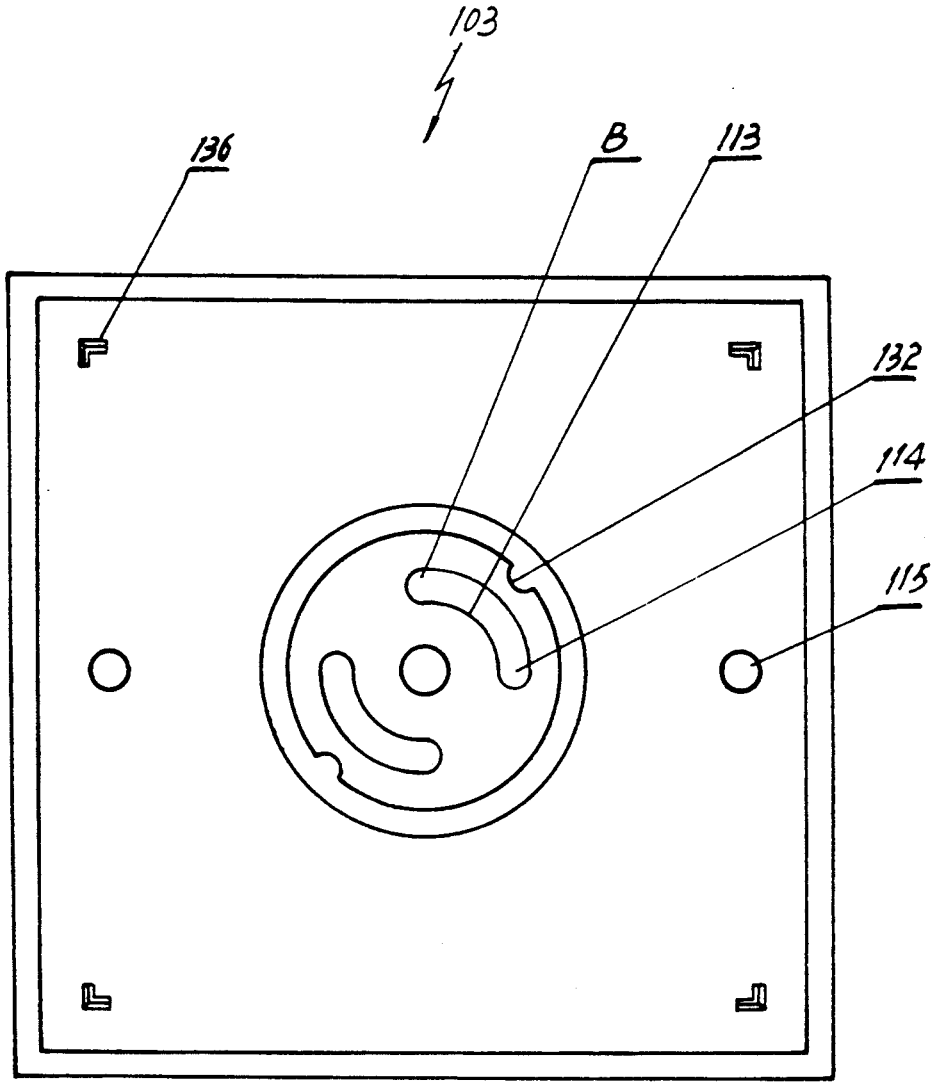
FIGS. 24 and 25 are schematic side views of the socket cover in FIG. 23.
Figure 30:
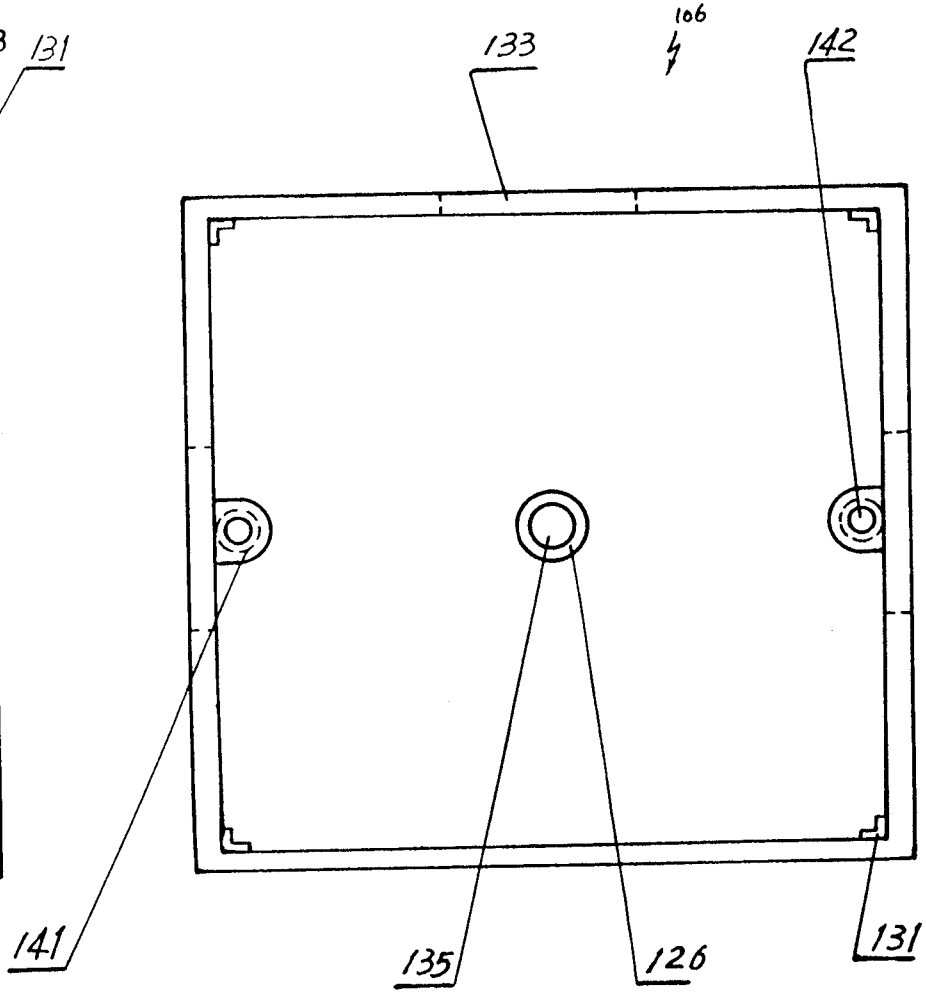
FIG. 30 is a schematic side view of the socket case in FIG. 29.
Figure 29:
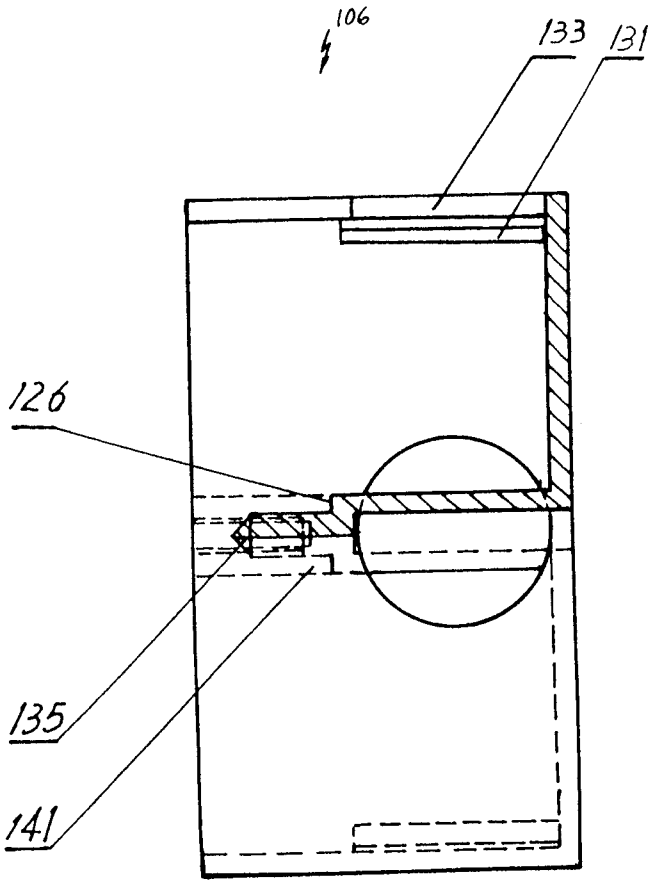
FIG. 29 is a schematic sectional front view of the socket case of the third embodiment of FIG. 21.

As shown in FIG. 21, the socket case 106 is embedded in a wall and is a rectangular case (see FIGS. 29, 30). A needle post 135 is formed at the center of case 106, and extends along the center line thereof and terminates in a tapered tip. Two position protrusions 141 with threaded holes 142 are respectively formed on the lateral walls of the case 106. In the four corners of the case 106 there are also four position blocks 131, the top faces of which is in the same plane as the positioning top faces of the position protrusions 141 to axially position the connection element 105.

Figures 31, 32, 33:
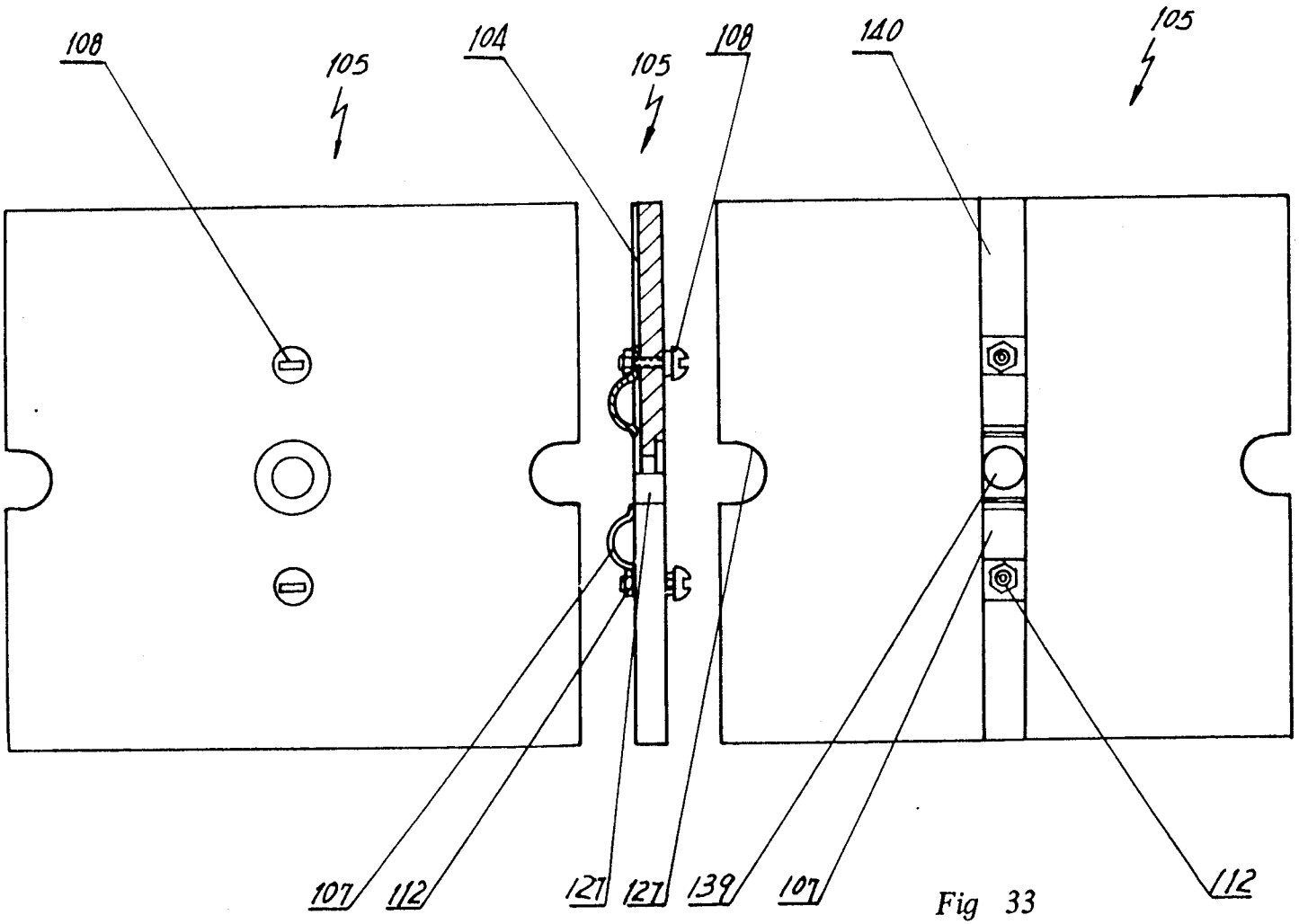
FIG. 31 is a schematic partially sectional front view of the connection element of the third embodiment of FIG. 21.
FIGS. 32 and 33 are side views of the connection element in FIG. 31.
Figure 35:
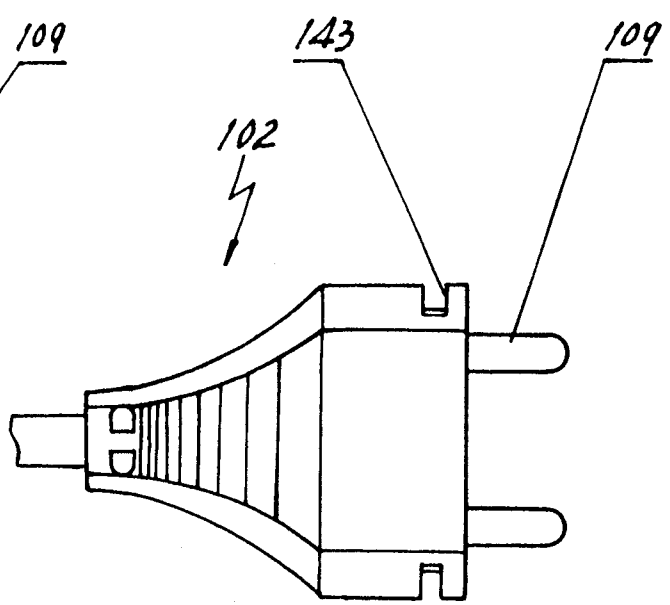
FIG. 35 is a schematic side view of the plug in FIG. 34.
Figure 34:
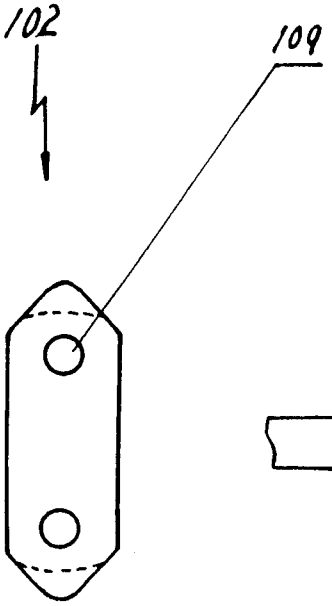
FIG. 34 is a schematic front view of the plug of the third embodiment in FIG. 21.

The connection element 105 is also rectangular (see FIGS. 31, 32, 33). Bolts 108 and nuts 112 fix the contact reeds 107 in the restricting grooves 140 and connect with the power supply wire 110 as terminals. The power supply wire 110 enters the socket case 106 from the wire hole 133 therein. The needle post hole 139 is provided at the center of the connection element 105 to receive the needle post 135 of the socket case 106 and two position recesses 127 are respectively formed on the lateral side of the element 105 to snug the position protrusions 141 of the socket case 106.

The socket cover 103 is rectangular and at its center a cylinder extends along the center line thereof, the inner surface of which forms a cylindrical space 134 with a diameter slightly greater than that of the enveloping curve of the outer circumferential surface of the insertion element 104. Two symmetrical circular projections 132 (see FIGS. 23 and 24) are provided at the inner surface of the space 134. A needle post hole 137 is formed at the center of the bottom of the cylinder. Also in the bottom of the cylinder two arcuate grooves 113 are formed, the width and position of which are corresponding to the diameter and position of the pins 109. Position blocks 136 are provided respectively in the four corners of the socket cover.

The insertion element 104 (FIGS. 26, 27, 28) is also circular and 8 pairs of the teeth 123 are formed uniformly around the outer circumferential surface thereof. A needle post 138 is formed to extend along the center line of the element 104 to cooperate with the needle post hole 137 of the cover 103. In the other side (A side) of the element 104 a needle post hole 124 is formed. The element 104 also has jacks 120, the number, size and shape of which are corresponding to that of the pins 109 and in which conductive elements 122 are mounted. The element 104 is arranged in the cylindrical space of the cover 103.

The socket cover 103 with the element 104 mounted therein is fixed at one of the sides of the socket case 106 in such a manner that the position protrusions 136 props against the connection element 105, that the needle post 135 is received in the needle post hole 124, and that bolts passes through the holes 115 and are screwed in the threaded holes 142 (FIG. 30) to secure the cover 103, so that the insertion element 104 can only rotate with the restriction of the axial movement.

Figure 25:
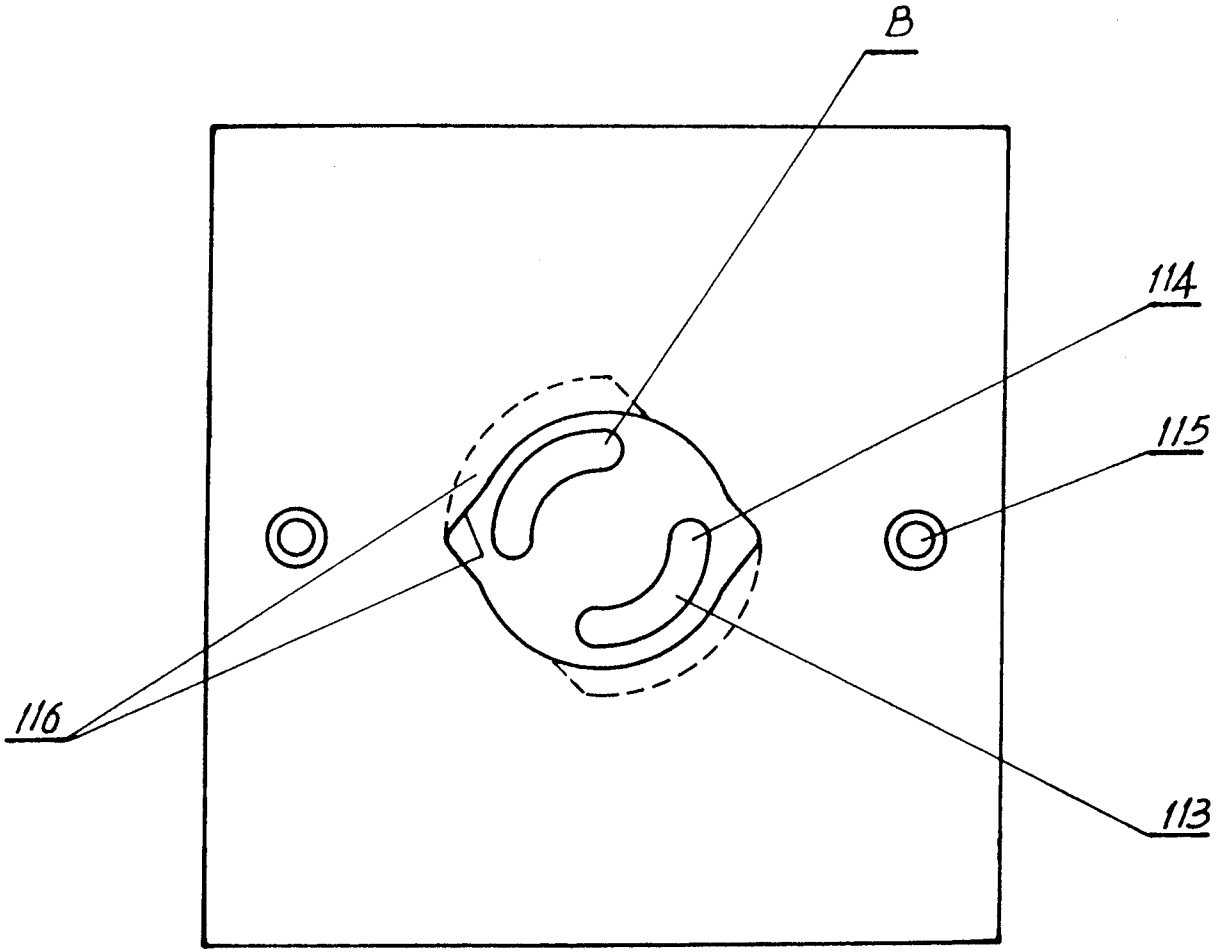
Figures 26, 27, 28:
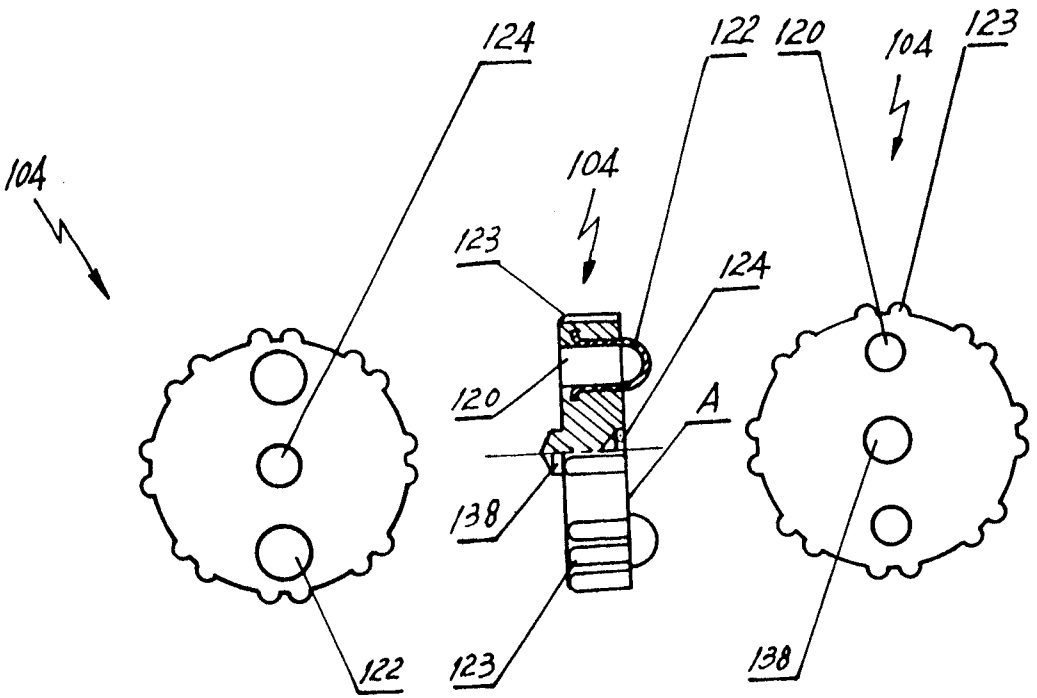
FIG. 26 is a schematic partially sectional front view of the insertion element of the third embodiment of FIG. 21.
FIGS. 27 and 28 are schematic side views of the insertion element of FIG. 26.

Two protrusions 143 (FIGS. 34 and 35) are formed on the plug body of the plug 102 and two circumferential concaved areas 116 are formed in the cover 103 and near the outer side thereof (FIG. 25). The projections 143 can enter the concaved areas 116 from corresponding recesses and rotate therealong.

The electric connection steps of above device are as follow: first aligning the protrusions 143 of the plug 102 with the corresponding recesses and then inserting them into the areas 116 so that the pins 109 are inserted into the jacks 120 at the ends 114 of the arcuate grooves 113, and then turning the plug in such a manner that the protrusions 143 move along the areas 116 to force the insertion element 104 to rotate so that the conductive elements 122 connect with the reeds 107 to turn on the electric power. If desired to cut off the power supply, the parts are operated in reverse.

Figure 36:
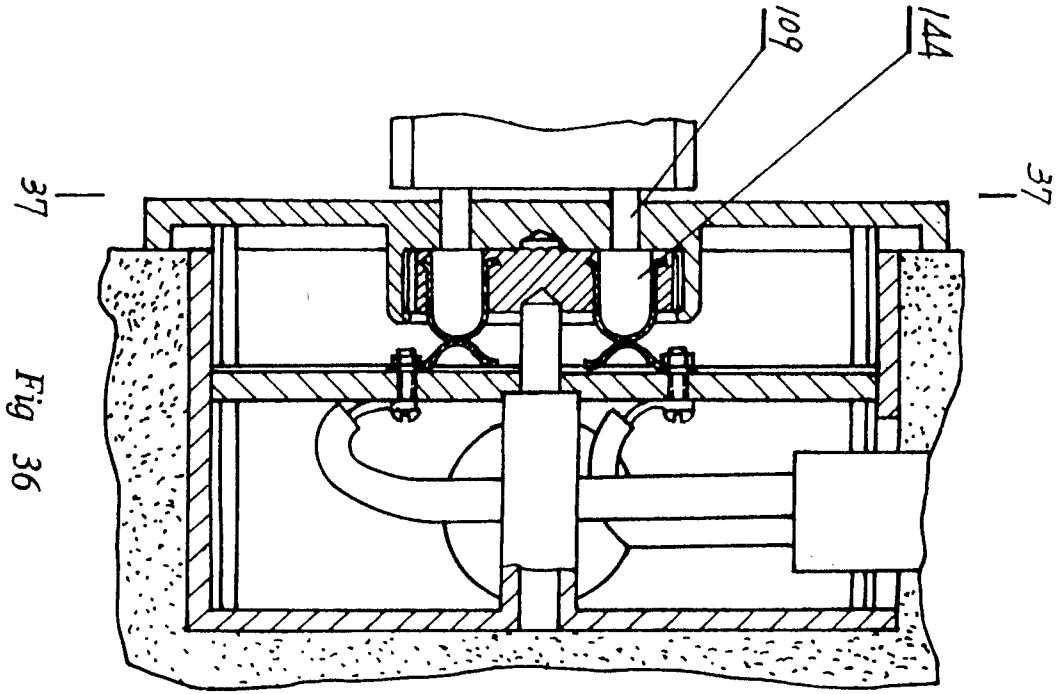
FIG. 36 is a schematic partially sectional front view of a assembly according to the fourth embodiment of the invention.
Figure 37:
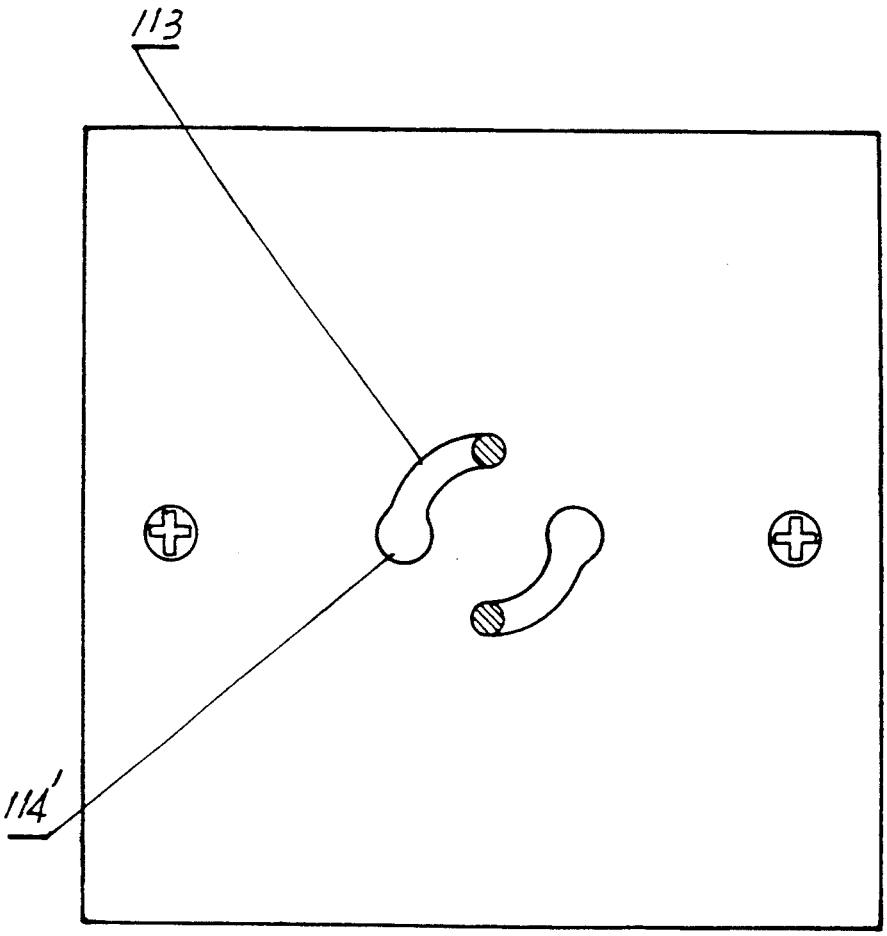
FIG. 37 is a schematic side view of the assembly in FIG. 36.

The electric connection device (FIGS. 36, 37) according to the fourth embodiment of the invention has the generally same structure as the third one and the difference between them is that the device of the fourth embodiment has no protrusions 143 on the plug body and concaved areas 116 in the socket cover 103. In this embodiment, the pins 9 terminate in enlarged tips 144 and the arcuate grooves 113 have corresponding enlarged portions 114' with a width greater than the diameter of the enlarged tips 144. The width of the other portions of circular grooves 113 is greater than the diameter of the pins 109 and less than the diameter of the enlarged tips 144.

Figure 38:
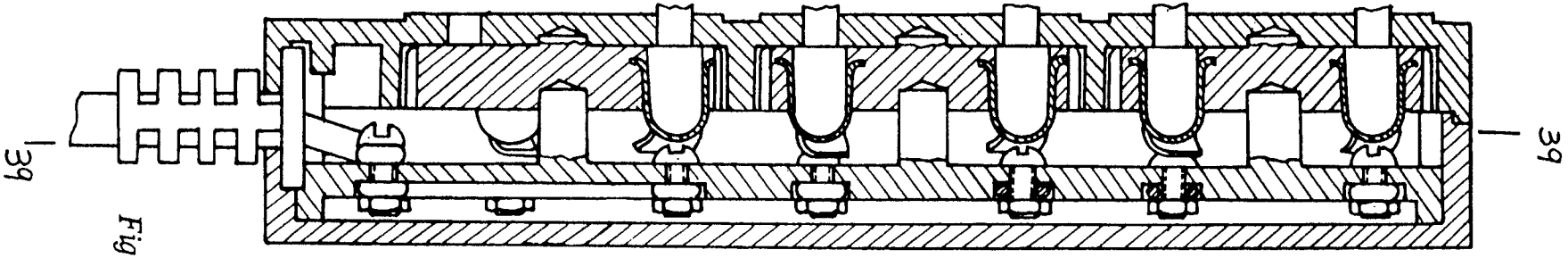
FIG. 38 is a schematic sectional front view of the device according to the fifth embodiment of the invention.
Figure 39:
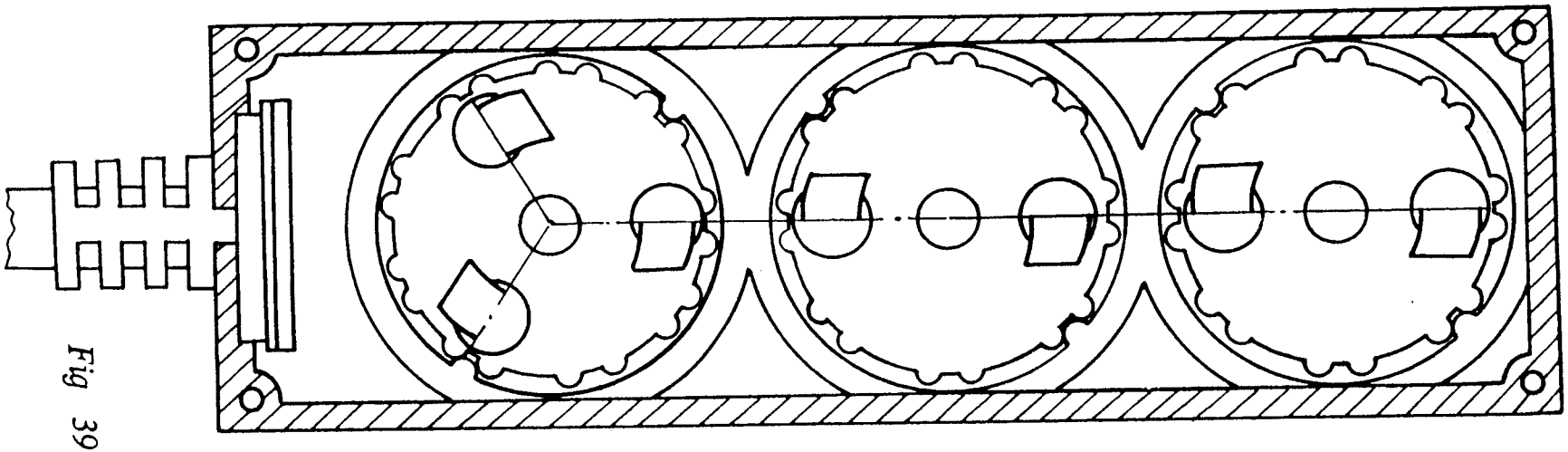
FIGS. 39 and 40 are schematic side views of the device in FIG. 38.
Figure 40:
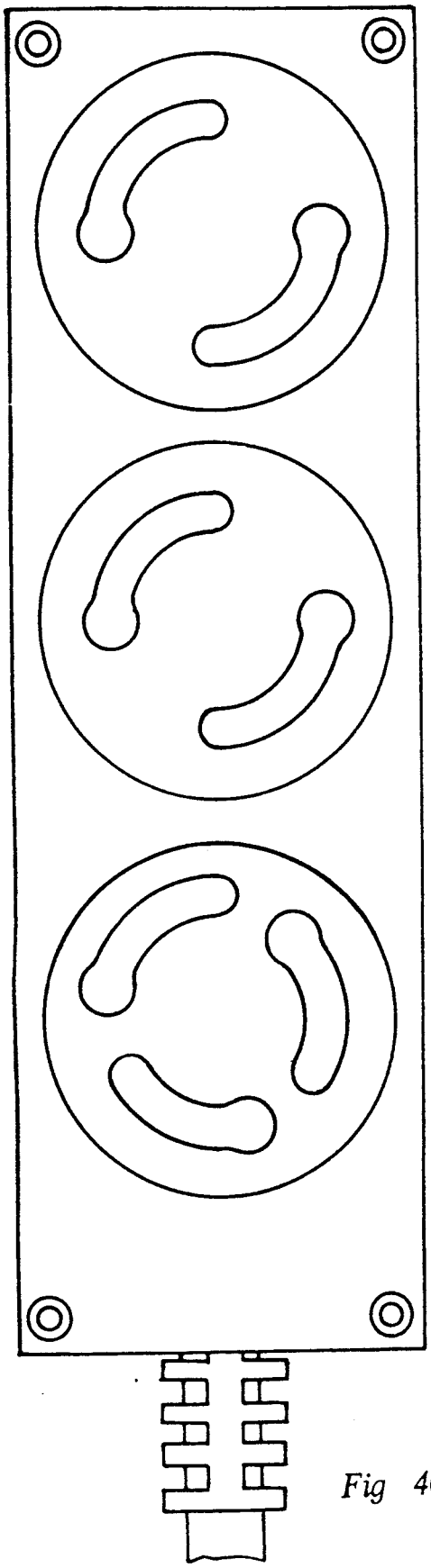

The electric connection device (FIGS. 38, 39, 40) provided by the fifth embodiment of the invention is different from the fourth one in that three socket elements are formed integrally to be one patch board.

From above description of the embodiments, It is found that the method and the device provided by the present invention has advantages of no arcing, simple structure and conveniently operation.

While the description of the invention has been given with respect to a preferred embodiment, it is not to be constructed in a limited sense. Variations and modification will occur to those skilled in the art. Reference is made to the appended claims for a definition of the invention.

What is claimed is:

1. A safety non-arcing electric connection device, which comprises a plug and a socket unit;

said plug comprises pins adapted to be connected to electric power, a plug body and position means for guiding the insertion of said socket unit into said plug;

said socket unit comprising a socket cover, a socket case, an insertion element and a connection element; one end of said socket case being fixedly closed by said socket cover and the other end thereof being formed with a power wire hole through which an electric power wire passes; said insertion element and said connection element being arranged in the space formed by said socket cover and said socket case;

a plurality of arcuate grooves formed through said socket cover corresponding to the pins of said plug in number, width, the relative position to the center of rotation axis and the relative position to each other, so that said pins can be inserted into said grooves and so that said socket unit can be rotated relative to said plug;

said insertion element comprising a round block housing jacks which correspond to said pins in number, shape, size, and the position relative to its rotation axis and to each other, so that said pins are able to be inserted into said jacks; each of said jacks having a conductive metal element;

the outer circumferential surface of the said insertion element having eight pairs of teeth generally uniformly formed of pillar shape in cross section; and said insertion element having axial positioning means;

said axial positioning means of said insertion element comprising a stepped needle post which is formed at the center of the insertion element and extends along the center line thereof, and a stepped hole which is formed at the center of said socket cover to receive said stepped needle post;

said connection wire element having contact points for connection to electric power via said electric power wire and being fixedly arranged in the socket case; the contact points correspond to said pins of said plug in number and the positions relative to the rotation axis and to each other, so that said pins are able to conveniently contact with and detach from said contact points;

said socket unit being formed with a cylindrical space with a diameter slightly greater than the diameter of maximum enveloping curve of said insertion element, two pillar shaped projections are generally uniformly formed and extends centripetally from the inside wall of said socket case and into said cylindrical space to fit with the teeth formed on said insertion element; said insertion element being turnably arranged in said cylindrical space with means to restrict its axial movement therein;

and said means for restricting the axial movement of said insertion element in said cylindrical space comprising a needle post hole which is formed in the insertion element along the center line thereof and terminates in a tapered bottom, and a needle post, which is formed on and extends from said connection element along the center line thereof and terminates in a tapered tip.

2. A safety non-arcing electric connection device according the claim 1, wherein said position means for guiding the insertion of said socket unit into said plug comprises protrusions which are formed on the plug body and extend centripetally, and concave areas which are formed in the outside of said socket unit to receive said protrusions.

3. A safety non-arcing electric connection device, which comprises a plug and a socket unit;

said plug comprises pins adapted to be connected to electric power, a plug body and position means for guiding the insertion of said socket unit into said plug;

said socket unit comprising a socket cover, a socket case, an insertion element and a connection element; one end of said socket case being fixedly closed by said socket cover and the other end thereof being formed with a power wire hole through which an electric power wire passes; said insertion element and said connection element being arranged in the space formed by said socket cover and said socket case;

a plurality of arcuate grooves formed through said socket cover corresponding to the pins of said plug in number, width, the relative position to the center of rotation axis and the relative position to each other, so that said pins can be inserted into said grooves and so that said socket unit can be rotated relative to said plug;

said insertion element comprising a round block having jacks which correspond to the pins in number, shape, size, and the position relative to its rotation axis and to each other, so that said pins are able to be inserted into said jacks; each of said jacks having a conductive metal element;

the outer circumferential surface of the said insertion element having eight pairs of teeth generally uniformly formed of pillar shape in cross section; and said insertion element having axial positioning means;

said axial positioning means of said insertion element comprising a needle post and a needle post hole which receives said needle post; said needle post being in alignment with the center line of said insertion element, extends along the center line of said insertion element, and terminates in a tapered tip; said needle post hole is arranged at the center of said insertion element and terminates in a tapered bottom;

said connection element having contact points for connection to electric power via said electric power wire and being fixedly arranged in the socket case; the contact points correspond to said pins of said plug in the number and the positions relative to the rotation axis and to each other, so that said pins are able to conveniently contact with and detach from said contact points;

said socket unit being formed with a cylindrical space with a diameter slightly greater than the diameter of maximum enveloping curve of said insertion element, two pillar shaped projections are generally uniformly formed and extend centripetally from the inside wall of said socket case and into said cylindrical space to fit with the teeth formed on said insertion element; said insertion element being turnably arranged in said cylindrical space with means to restrict its axial movement therein;

said means for restricting the axial movement of said insertion element in said cylindrical space comprising a needle post which is formed on and extends from said insertion element along the center line thereof and terminates in a tapered tip, and a needle post hole which is formed in said socket cover and terminates in a tapered bottom.

4. A safety non-arcing electric connection device according to claim 3, wherein said position means for guiding the insertion of said socket unit into said plug comprises protrusions which are formed on the plug body and extend radially inwardly, and concave areas which are formed in said socket case on the outside thereof to receive said protrusions.

5. A safety non-arcing electric connection device according to claim 1, wherein said position means for guiding the insertion of said socket unit into said plug has such a structure that: at least one enlarged portion is formed at the end of each of said pins; the width of said arcuate grooves is greater than the maximum size of the cross section of the pins and less than the maximum size of the cross section of the enlarged portions of the pins; and at each of the two corresponding ends of said grooves there is a enlarged portion of said grooves, the diameter of which is greater than the maximum size of the cross section of the enlarged portions of said pins.

6. A safety non-arcing electric connection device according to claim 3, wherein said position means for guiding the insertion of said socket unit into said plug has such a structure that: at least one enlarged portion is formed at the end of each of said pins; the width of said arcuate grooves is greater than the maximum size of the cross section of the pins and less than the maximum size of the cross section of the enlarged portions of the pins; at each of the two corresponding ends of said grooves there is a enlarged portion of said grooves, and the diameter of which is greater than the maximum size of the cross section of the enlarged portions of said pins.

* * * * *